US010786090B2

(12) United States Patent
Zhang

(10) Patent No.: US 10,786,090 B2
(45) Date of Patent: Sep. 29, 2020

(54) MATTRESS FOR EVENLY GATHERING AND DISPERSING HUMAN BODY GRAVITY

(71) Applicant: Shaohua Zhang, Nanchang (CN)

(72) Inventor: Shaohua Zhang, Nanchang (CN)

( * ) Notice: Subject to any disclaimer, the term of this patent is extended or adjusted under 35 U.S.C. 154(b) by 704 days.

(21) Appl. No.: 14/960,382

(22) Filed: Dec. 6, 2015

(65) Prior Publication Data

US 2016/0081488 A1 Mar. 24, 2016

Related U.S. Application Data

(63) Continuation-in-part of application No. PCT/CN2014/077864, filed on May 20, 2014.

(30) Foreign Application Priority Data

Jun. 6, 2013 (CN) ..... 2013 1 0222649
Jul. 19, 2013 (CN) ..... 2013 2 0430806 U

(51) Int. Cl.
*A47C 27/08* (2006.01)
*A47C 27/05* (2006.01)

(52) U.S. Cl.
CPC ..... *A47C 27/086* (2013.01); *A47C 27/056* (2013.01); *A47C 27/087* (2013.01); *A47C 27/088* (2013.01)

(58) Field of Classification Search
CPC ..... A47C 27/086; A47C 27/08; A47C 27/087; A47C 27/088
See application file for complete search history.

(56) References Cited

U.S. PATENT DOCUMENTS 4,197,602 A * 4/1980 Johenning ..... A47C 27/085 5/411
4,245,361 A * 1/1981 Evanson ..... A47C 27/088 5/680

(Continued)

FOREIGN PATENT DOCUMENTS

EP 371184 A1 * 6/1990 ..... A47C 27/086
FR 2178524 A5 * 11/1973 ..... A47C 27/086

OTHER PUBLICATIONS

English Translation of the International Search Report for WO 2014194756 (Year: 2014).*
English Translation of FR 2178524 (Year: 1973).*

*Primary Examiner* — Eric J Kurilla
*Assistant Examiner* — Amanda L Bailey
(74) *Attorney, Agent, or Firm* — Wayne & Ken, LLC; Tony Hom

(57) ABSTRACT

A mattress for evenly gathering and dispersing human body gravity comprises elastic surface layer connecting cloth (1), elastic support frames (2), lateral connecting cloth (3), a filling region (4), granular fillers (5), a filler inlet/outlet (6), lower connecting cloth (7), a foot limiting belt (8), a leg limiting belt (9), hip limiting belts (10) and a back limiting belt (11) ("limiting belts" for short). The width of each of the limiting belts (8, 9, 10, 11) is less than that of the filling region. Upper ends and lower ends of the limiting belts (8, 9, 10, 11) are separately connected to an upper cloth layer and a lower cloth layer. When the mattress is stressed by human body gravity, the granular fillers automatically move towards a gravity-free region and fill a gap between the human body and the mattress, so as to provide a larger balanced stress surface for the human body and realize balancing of the human body gravity. The mattress is self-adaptive to a posture of lying on the side or lying on the back, so that no pillow is required. The mattress has func- (Continued)

tions of improving blood circulation and relieving fatigue of joints and muscles, and can avoid discomfort due to uneven stress. The mattress is partitioned into one or more independent filling regions by lateral upright partitioning cloth (12), so that the mattress can be used by one or more persons.

6 Claims, 8 Drawing Sheets

(56) References Cited

U.S. PATENT DOCUMENTS 4,425,676 A * 1/1984 Crane ..... A61G 7/05746 5/689
4,607,403 A * 8/1986 Alivizatos ..... A47C 27/086 5/482
4,862,535 A * 9/1989 Roberts ..... A47C 27/086 5/655
6,098,223 A * 8/2000 Larson ..... A47C 27/088 5/716
6,499,166 B1 * 12/2002 Jones ..... A47C 20/048 5/615
2002/0040502 A1 * 4/2002 Woolfson ..... A47C 21/046 5/690
2009/0146481 A1 * 6/2009 Fernandez Perez ... A47C 31/11 297/452.1
2010/0031448 A1 * 2/2010 Hijlkema ..... A47C 21/044 5/702
2011/0107521 A1 * 5/2011 Alder ..... A47C 27/087 5/706
2011/0179576 A1 * 7/2011 Regan ..... A47G 9/10 5/645
2011/0212658 A1 * 9/2011 Vandeplancke ..... C09K 21/12 442/144
2013/0145549 A1 * 6/2013 Piegdon ..... A61G 7/00 5/600

* cited by examiner

MATTRESS FOR EVENLY GATHERING AND DISPERSING HUMAN BODY GRAVITY

CROSS-REFERENCE TO RELATED APPLICATIONS

This application is a continuation-in-part of International Patent Application No. PCT/CN2014/077864 with an international filing date of May 20, 2014, designating the United States, now pending, and further claims priority benefits to Chinese Patent Application No. 201310222649.3 filed Jun. 6, 2013 and Chinese Patent Application No. 201320430806.5 filed Jul. 19, 2013. The contents of all of the aforementioned applications, including any intervening amendments thereto, are incorporated herein by reference.

TECHNICAL FIELD

The present invention relates to household sleep articles, in particular to a mattress for evenly gathering and dispersing human body gravity.

BACKGROUND OF THE PRESENT INVENTION

Sleep necessaries for human beings change with the development of human civilization. Particularly, with the emergence of modern industrial civilization and the rise of associated sciences, in the human society, various types of new sleep products emerge in endlessly, from the popularity and sweeping the world of "Simmons" spring mattresses to the prevalence of various mattresses, such as elastic foam mattresses, memory foam mattresses, inflatable mattresses, water-filled mattresses and latex mattresses, for adapting to the sleep needs of different persons. However, since all those mattresses have their own defects, they are unable to solve the majority of problems during sleeping and even have side effects to result in sleep disorder and harm. For example, spring mattresses are likely to cause the damage of human spine and thus result in cervical spondylosis, thoracic spondylosis and lumbar spine diseases foam mattresses are unable to ensure that the human body gravity is evenly dispersed on the mattresses and thus unable to effectively eliminate fatigue of sleep; latex mattresses are high in manufacturing cost, and the harmful smell generated by the oxidization of latex, the contact anaphylaxis of the human body to latex and other hazards are unavoidable, so that the latex mattresses are also unable to eliminate fatigue of sleep.

All over the world, no matter the mattresses are manufactured by which materials, structures and processes, designers always separate "head from trunk" of the human body and are thus trapped in a combined design "mattress+pillow", and this combined design proposes a problem about how to harmonize the "human body, mattress and pillow". The disharmonious relationship and irreconcilable conflict of the "human body, mattress and pillow" are the source of human sleep disorder and sleep diseases, and also the difficulty in solving the sleep problems in the modern science. At present, the mattress design concept still stays at the level of passively adapting the human body to the mattress and pillow. However, due to the difference of human body forms, people may need mattresses and pillows in different elasticity and height. Therefore, the conventional mattresses and pillows are unable to solve various problems during sleeping. Although such mattresses and pillows may be produced in mass, they have various defects.

At present, there are self-adaptive mattresses. Such self-adaptive mattresses are generally filled of flowing fillers. The fillers move with the change of pressure, so that the contact shape of the human body with the mattress may be quickly adapted, and the human body pressure is evenly balanced. For example, Chinese Utility Model Patent ZL200920316371.5 has disclosed a plant fiber and elastic sphere composite mattress, which solves the self-adaptive problem of mattresses. However, since it is unable to buffer the velocity of movement of spheres, the flowability of the filling spheres is very high, and as a result, it is very likely to change the overall shape of the mattress or even make a sleeper fall off the mattress. Moreover, when the mattress suffers an external force suddenly, the filling spheres shock the outer wall to result in crack. Therefore, the mattress of such a structure has poor structural stability and low actual use value.

SUMMARY OF THE PRESENT INVENTION

An objective of the present invention is to provide a mattress for evenly gathering and dispersing human body gravity, which has rational structure and high strength and may provide a larger balanced stress surface for the human body and be self-adaptive to a posture of lying on the side or lying on the back thus to realize balancing of the human body gravity so that no pillow is required. The mattress has functions of improving blood circulation and relieving fatigue of joints and muscles, and can avoid discomfort due to uneven stress.

The objective of the present invention is realized as below. A mattress for evenly gathering and dispersing human body gravity is provided, including elastic surface layer connecting cloth, elastic support frames, lateral connecting cloth, a filling region, granular fillers, a filler inlet/outlet, lower connecting cloth, a foot limiting belt, a leg limiting belt, hip limiting belts and a back limiting belt, characterized in that upper surfaces of the elastic support frames are connected to the elastic surface layer connecting cloth while lower surfaces thereof are connected to the lower connecting cloth; front sides and rear sides of the elastic support frames are connected to the lateral connecting cloth; the filler inlet/outlet is provided on the lateral connecting cloth; a space formed by the elastic support frames, the elastic surface layer connecting cloth, the lower connecting cloth and the lateral connecting cloth is the filling region in which the granular fillers are filled, and the foot limiting belt, the leg limiting belt, the hip limiting belts and the back limiting belt ("limiting belts" for short), which are arranged in parallel, are provided in the filling region; an upper end and a lower end of each of the limiting belts for parts of the human body are connected to the elastic surface layer connecting cloth and the lower connecting cloth, respectively, and the width of each of the limiting belts is less than that of the filling region, such that a passage substantially perpendicular to the limiting belts for flow of the granular fillers is formed on each side of the limiting belts; the passage communicates with the areas limited by the limiting belts.

Preferably, the granular fillers are movable granules of a spherical or oval structure. Such a structure enables the granular fillers to quickly roll under the gravity.

There are two hip limiting belts, in order to reduce the flowability of the granular fillers in the hip region, enhance the stability of support and increase the tensile strength of the mattress.

The lower connecting cloth is formed by compounding a layer of warp-knitted reticulate cloth on one piece of cloth having good air permeability and thermal conductivity. Such cloth includes three faces, i.e., a surface, a middle layer and a bottom face, where the surface is of a mesh design, the middle layer is MOLO yarn for connecting the surface and the bottom face, and the bottom face is a densely woven flat face. Such cloth is commonly called "sandwich". The present invention employs such cloth and such a process to enhance the air permeability of the mattress surface.

One piece of lateral connecting cloth, located on a side of the two elastic support frames and close to the foot limiting belt, is replaced by an elastic support frame. Such a structure enables the mattress to have elastic support frames in three adjacent directions so as to strengthen the structure of the mattress.

The fillers in the elastic support frames refer to elastic material, for example, polyurethane foam or hollow cotton, and lateral upright isolating cloth, used for isolating the granular fillers, is provided on a side of the elastic support frames close to the filling region.

Preferably, one piece of lateral upright partitioning cloth is provided on the mattress for evenly gathering and dispersing human body gravity in a direction vertical to each of the limiting belts, the filling region is partitioned into two independent filling regions by the lateral upright partitioning cloth, and an upper end and a lower end of the lateral upright partitioning cloth are connected to the elastic surface layer connecting cloth and the lower connecting cloth, respectively. Partitioned by the lateral upright partitioning cloth, the mattress may form filling regions for bearing two persons independently.

The present invention has the following technical effects. Since the mattress for evenly gathering and dispersing human body gravity considers the human body gravity as a "whole" to set related structures and materials, when the mattress is stressed by the human body, the internal granules will automatically move towards a gravity-free region along a predetermined path so as to disperse the pressure of the highly stressed portion of the mattress. Meanwhile, the moving granules fill gaps corresponding to the shoulders, neck, waist, knees, ankles and other parts, so as to provide a largest balanced stress surface for the human body. By the balanced stress surface, a mild counterforce relationship between the human body and the mattress is established, so that the human body may obtain extreme comfort after the gravity is balanced and dispersed.

In addition, the elastic cloth surface layer of the mattress for evenly gathering and dispersing human body gravity has heat preservation properties of low moisture absorption and low heat conductivity and gives the sense of warmth to a person, so that no electric blanket is required in winter; and, the lower connecting cloth and the sandwich cloth have porous air permeability and thus make a person feel cool, so that no mat is required in summer. Therefore, the "mattress for evenly gathering and dispersing human body gravity" will not make a person feel discomfort. The used fillers, as well as the main and auxiliary materials, are all harmless to the human body, so that no any damage will be caused to the human body.

The innovative design concept of the mattress for evenly gathering and dispersing human body gravity, by integrating persons together with sleep articles, changes the sleep mode of adapting the human body to a mattress and a pillow in the present world, realizes the idea of meeting all persons by only one mattress, and eliminates the need of pillows, and is of innovative significance in the sleep article industry. The discomfort of the human body on a conventional mattress during sleeping is avoided. Particularly, the mattress has special health-care effects in the postoperative rehabilitation and prevention of bedsore of patients suffering from spine, scapulohumeral periarthritis or other arthritis, varicose veins and femoral head necrosis. The mattress makes economic and social sense in heath-caring, reducing the resource consumption by human beings and protecting the environment.

in which:

1: Elastic surface layer connecting cloth;
2: Elastic support frames;
3: Lateral connecting cloth;
4: Filling region;
5: Granular filiers;
6: Filler inlet/outlet;
7: Lower connecting cloth;
8: Foot limiting belt;
9: Leg limiting belt;
10: Hip limiting belts;
11: Back limiting belt;
12: Lateral upright partitioning cloth;
13: Lateral upright isolating cloth; and 14: passage.

DETAILED DESCRIPTION OF THE PRESENT INVENTION

Figure 1:
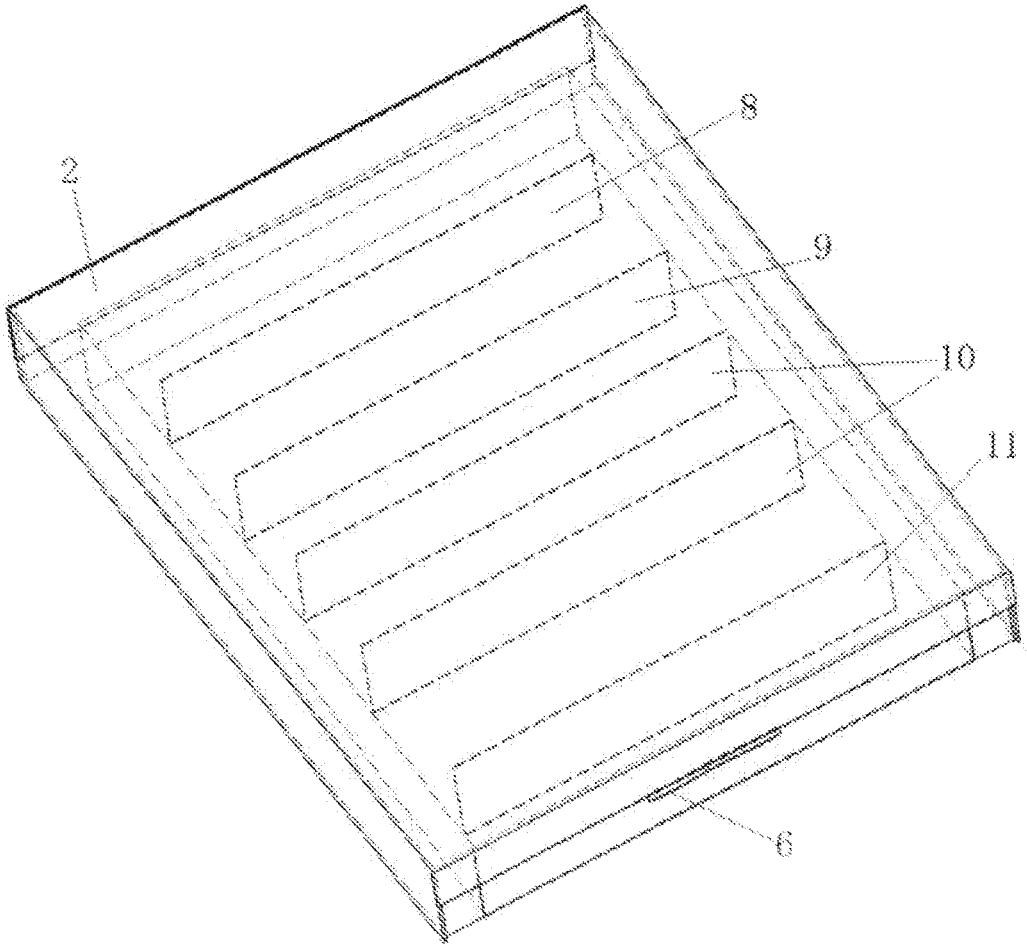
FIG. 1 is a structural diagram of a mattress according to the present invention, when used as a single-bed.
Figure 3:
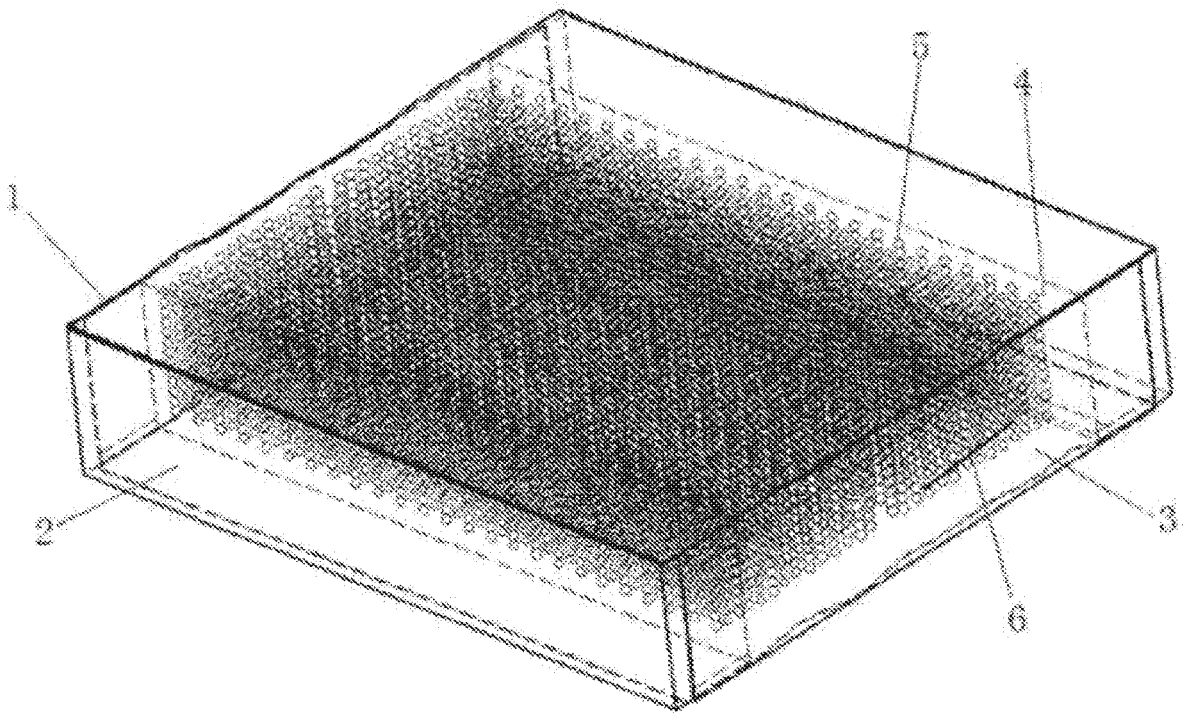
FIG. 3 is a structural front view of the mattress having two elastic support frames according to the present invention.
Figure 5:
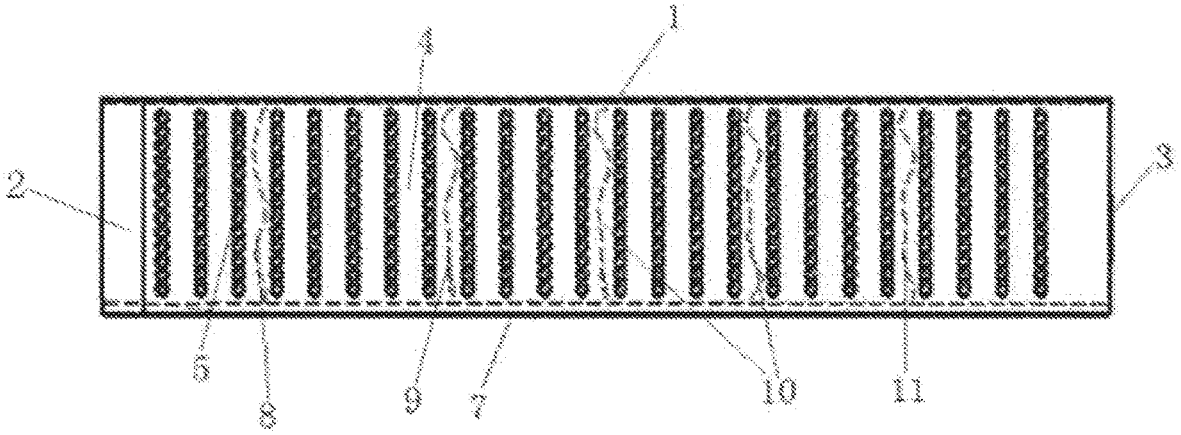
FIG. 5 is a side view of are internal structure of FIG. 4.

As shown in FIG. 1 and FIG. 3, the present invention is implemented as below. The structure of a mattress for evenly gathering and dispersing human body gravity is as shown in FIG. 5, FIG. 6, FIG. 7 and FIG. 8. The mattress includes elastic surface layer connecting cloth 1, elastic support frames 2, lateral connecting cloth 3, a filling region 4, granular fillers 5, a filler inlet/outlet 6, lower connecting cloth 7, a foot limiting belt 8, a leg limiting belt 9, hip limiting belts 10 and a back limiting belt 11, characterized in that upper surfaces of the two elastic support frames 2 are connected to the elastic surface layer connecting cloth 1 while lower surfaces thereof are connected to the lower connecting cloth 7; front sides and rear sides of the two elastic support frames 2 are connected to the lateral connecting cloth 3; the filler inlet/outlet 6 is provided on the lateral connecting cloth 3; a space formed by the elastic support frames 2, the upper elastic connecting cloth 1, the lower connecting cloth 7 and the lateral connecting cloth 3 is the filling region 4 in which the granular fillers 5 are filled, and the foot limiting belt 8, the leg limiting belt 9, the hip limiting belts 10 and the back limiting belt 11, which are arranged in parallel, are provided in the filling region 4, as shown in FIG. 5; an upper end and a lower end of each of the foot limiting belt 8, the leg limiting belt 9, the hip limiting belts 10 and the back limiting belt 11 are connected to the upper elastic connecting cloth 1 and the lower connecting cloth 7, respectively, and the width of each of the foot limiting belt 8, the leg limiting belt 9, the hip limiting belts 10 and the back limiting belt 11 is less than that of the filling region 4, such that a passage 14 substantially perpendicular to the limiting belts for flow of the granular fillers 5 is formed on each side of the limiting belts; the passage 14 communicates with the areas limited by the limiting belts. The granular fillers 5 are movable granules of a spherical or oval structure. Such a structure enables the granular fillers 5 to quickly roll.

There are two hip limiting belts 10. A supporting region for the hip is partitioned into two regions by the hip limiting belts, so as to reduce the flowability of the granular fillers 5 in the hip region and enhance the stability of support.

The lower connecting cloth 7 is composite reticulate sandwich cloth to enhance the elasticity of the mattress surface.

Figure 4:
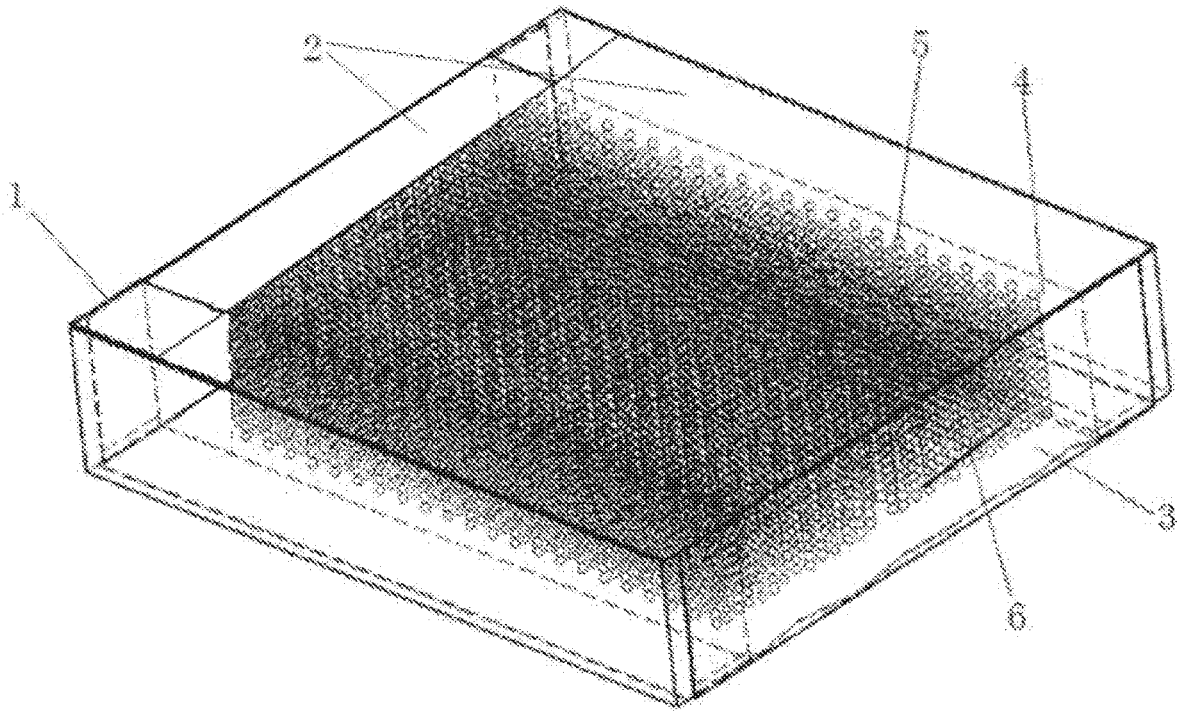
FIG. 4 is a structural front view of the mattress having three elastic support frames according to the present invention.

As shown in FIG. 4, one piece of lateral connecting cloth 3 located on the front and rear sides of the two elastic support frames 2 and close to the foot limiting belt 8 is replaced by an elastic support frame 2. Such a structure enables the mattress to have elastic support frames in three adjacent directions so as to strengthen the structure of the mattress.

Figure 6:
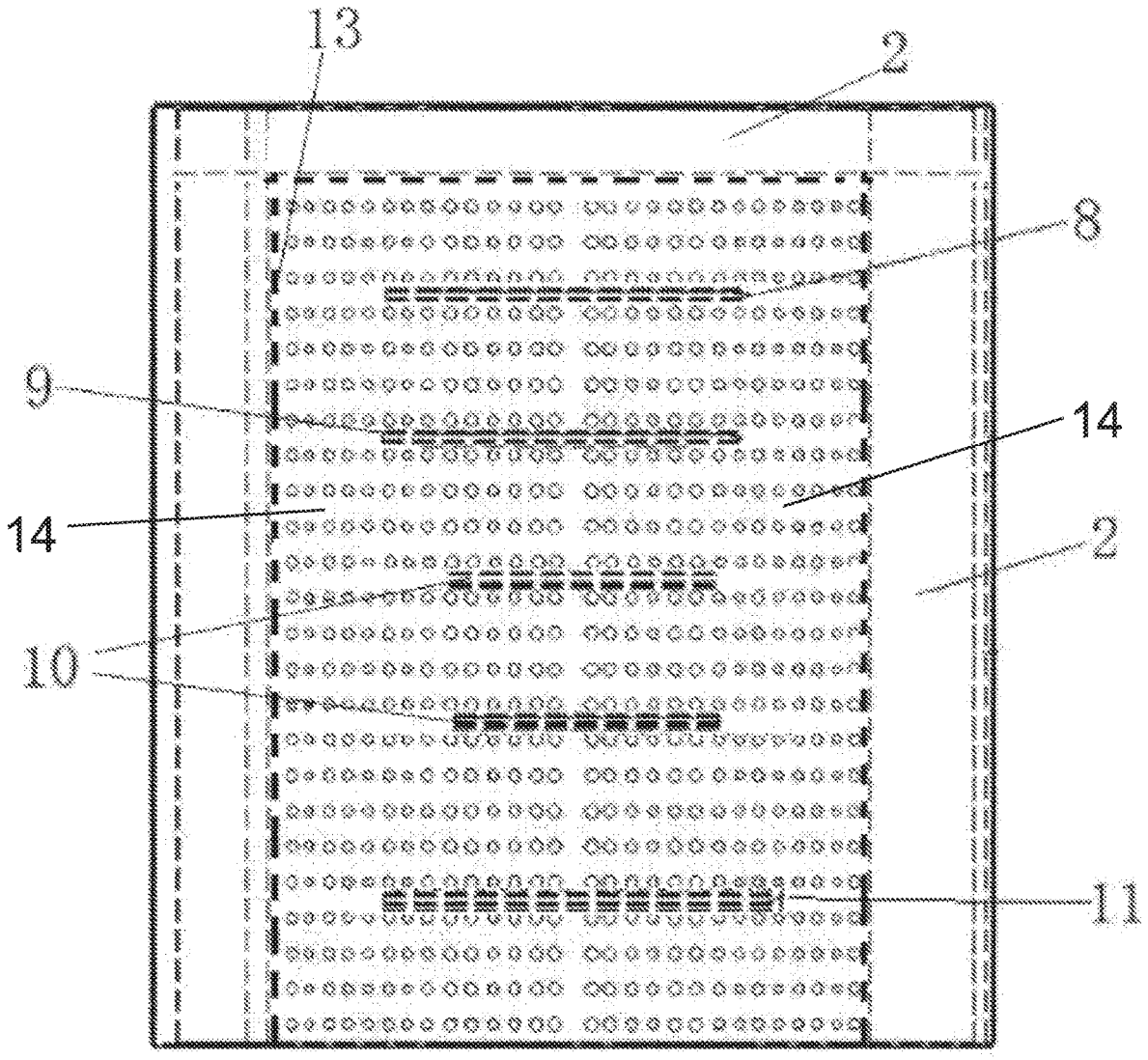
FIG. 6 is a top view of the internal structure of FIG. 4.
Figure 7:
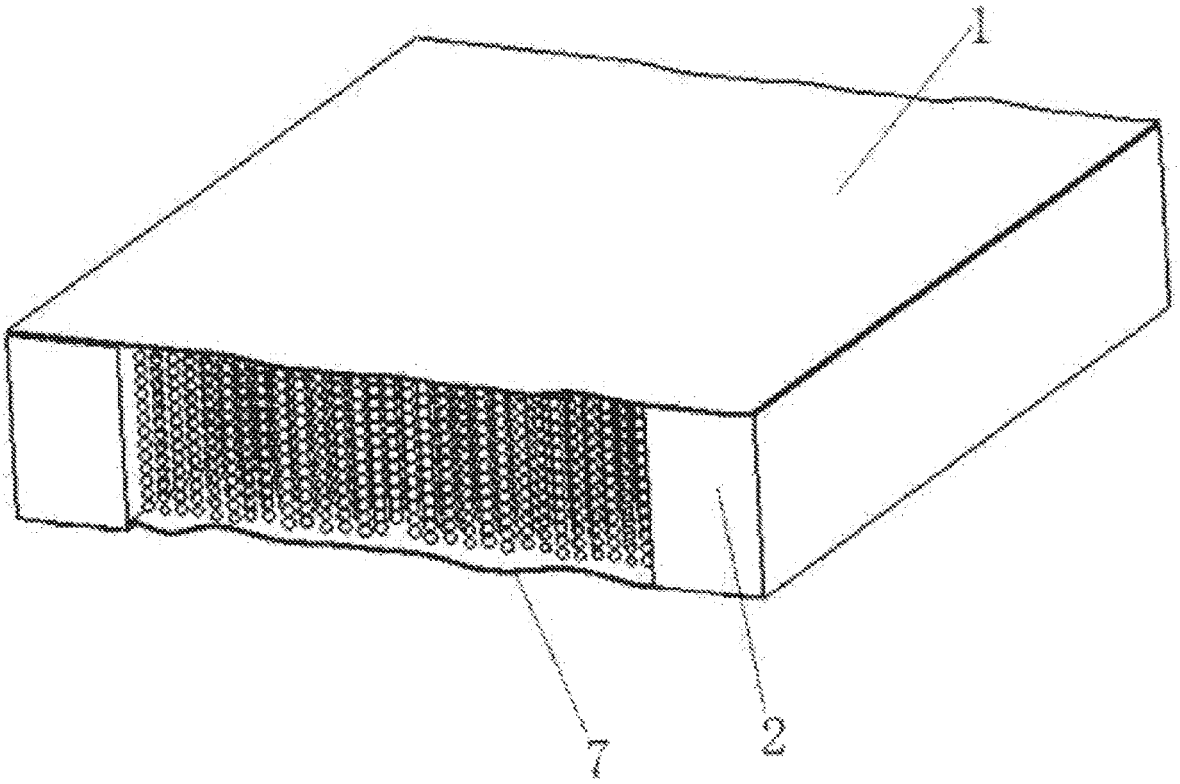
FIG. 7 is a side view of the position of internal granular fillers of he mattress according to the present invention.
Figure 8:
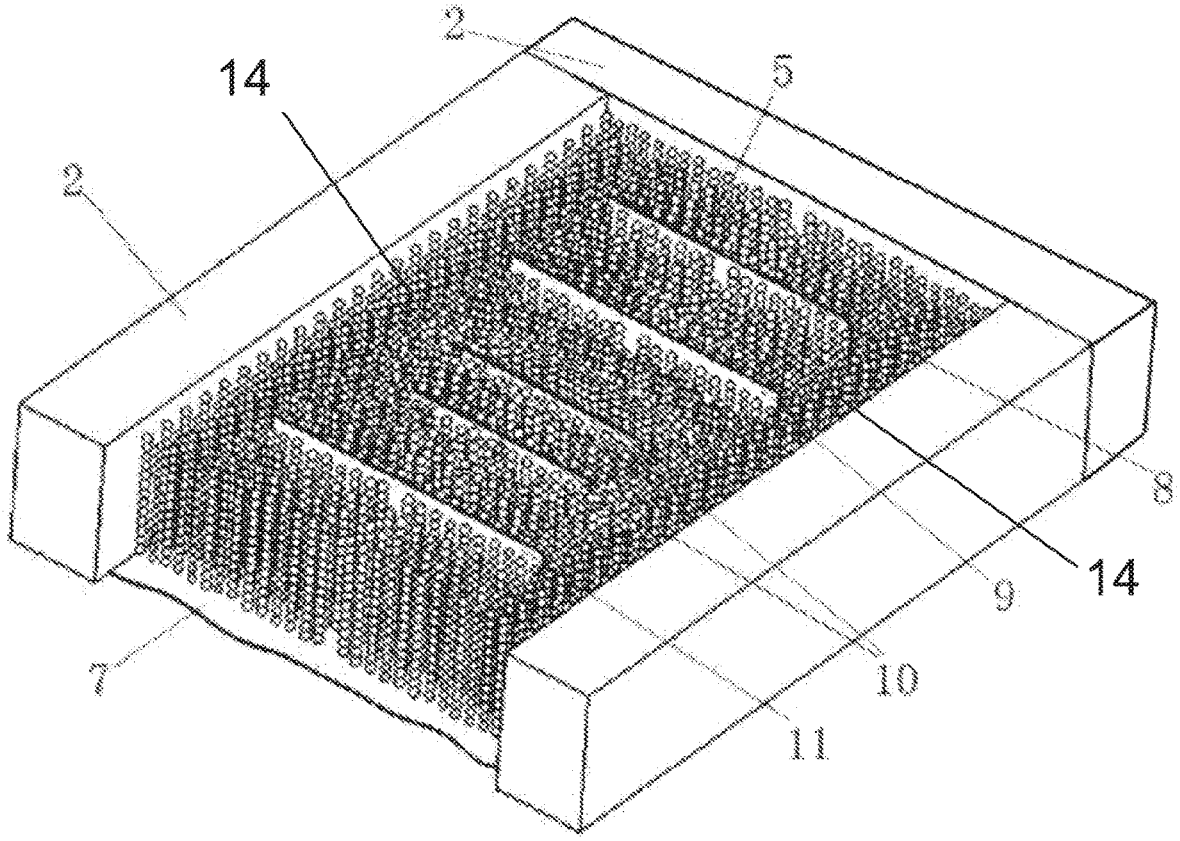
FIG. 8 is a schematic diagram of the position of the internal granular fillers of the mattress according to the present invention.

The fillers in the elastic support frames 2 refer to elastic material, for example, polyurethane foam or hollow cotton. As shown in FIG. 6, lateral upright isolating cloth 13, used for isolating the granular fillers 5, is provided on a side of the elastic support frames 2 close to the filling region 4.

In order to improve the applicability of the mattress, the mattress may be manufactured into a double-bed mattress structure. The structure thereof will be described as below.

Figure 2:
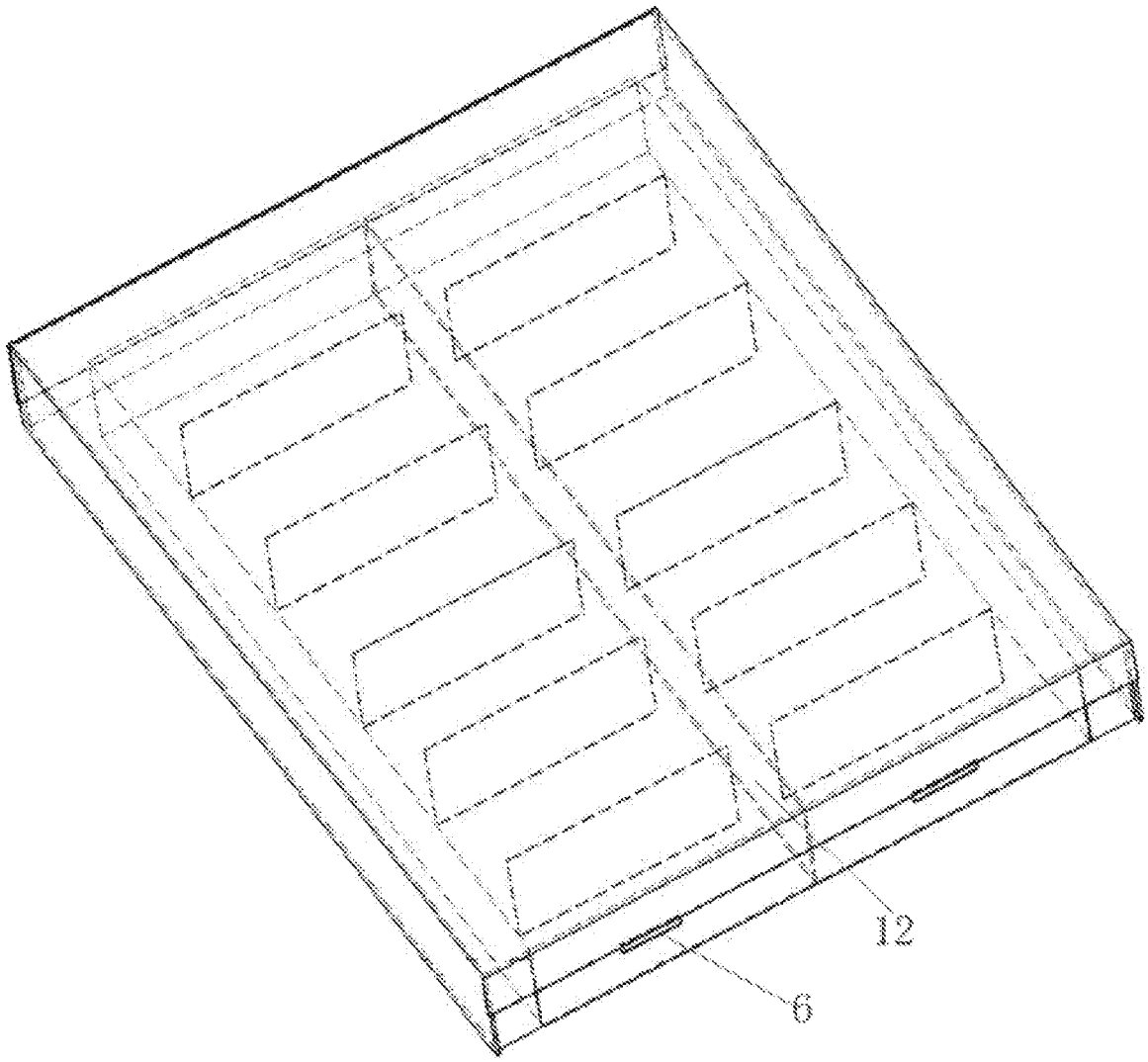
FIG. 2 is a structural diagram of the mattress according to the present invention, when used as a double-bed by the lateral upright partitioning cloth.

As shown in FIG. 2, at least one piece of lateral upright partitioning cloth 12 is provided on the mattress for evenly gathering and dispersing human body gravity in a direction vertical to each of the limiting belts. The filling region 4 is at least partitioned into two identical independent filling regions by the lateral upright partitioning cloth. An upper end and a lower end of the lateral upright partitioning cloth 12 are connected to the elastic surface layer connecting cloth 1 and the lower connecting cloth 7, respectively. Partitioned by the lateral upright partitioning cloth 12, the mattress may form identical filling regions for bearing two persons independently.

The implementation and working principle of the mattress of the present invention are as follows: the elastic support frames 2 are filled with flexible material, for example, polyurethane foam or hollow cotton, as a skeleton, and the granular fillers 5 are formed by foaming polystyrene (EPS) or polypropylene (EPP). During manufacturing, the elastic support frames 2 are fixed by seaming the elastic surface layer connecting cloth 1, the lower connecting cloth 7 and the lateral connecting cloth 3 together, so as to form a mattress skeleton in a regular shape; and then, the granular fillers 5 are filled into the filling region 4 from the filler inlet/outlet 6, and the mattress is shaped as the granular fillers 5 are continuously filled. When in use, the granular fillers 5 in the filling region 4 move due to different pressures and sizes of human bodies. Since each part of the human body has a different pressure on the mattress, the granular fillers 5 will move according to different pressures, so as to self-adapt to the shape of the human body and realize balancing of the pressure, thus to evenly balance and buffer the pressure of the human body coming into contact with the mattress. Due to the structural design of the foot limiting belt 8, the leg limiting belt 9, the hip limiting belts 10 and the back limiting belt 11, the granular fillers 5 move within corresponding regions of the foot limiting belt 8, the leg limiting belt 9, the hip limiting belts 10 and the back limiting belt 11. The foot limiting belt 8, the leg limiting belt 9, the hip limiting belts 10 and the back limiting belt 11 play an important role in buffering the granular fillers 5 and limiting the large-scale irregular movement of the granular fillers. In the present invention, under the human body gravity, the stressed fillers in the mattress move towards a gravity-free region, and the shape of the mattress is changed by the coordination of the elastic surface layer and the limiting belts. First, the pressure at a part highly stressed by the human body is dispersed; second, gaps corresponding to the shoulders, elbows, neck, spine, knees, ankles and other parts are filled to provide a balanced stress surface for the human body, so that fatigue or damage of the human body resulted from uneven stress may be avoided. By establishing a gravity balance relationship between the human body and the mattress, low quality of sleep, caused by the strain and pain of the shoulders, neck, lumbar vertebra, knees, ankles and other parts due to the stress of gravity to human body parts and improper postures and by the coldness, is solved. The present invention changes the conventional mattress concept, and no pillow is required during sleeping.

I claim:

1. A mattress for evenly gathering and dispersing human body gravity, comprising: an elastic surface layer connecting cloth, elastic support frames, lateral connecting cloth, a filling region, granular fillers, a filler inlet/outlet, lower connecting cloth, a foot limiting belt, a leg limiting belt, hip limiting belts and a back limiting belt; wherein upper surfaces of the elastic support frames are connected to the elastic surface layer connecting cloth while lower surfaces thereof are connected to the lower connecting cloth; front sides and/or rear sides of the elastic support frames are connected to the lateral connecting cloth; the filler inlet/outlet is provided on the lateral connecting cloth; a space formed by the elastic support frames, the elastic surface layer connecting cloth, the lower connecting cloth and the lateral connecting cloth is the filling region in which the granular fillers are filled; and the foot limiting belt, the leg limiting belt, the hip limiting belts and the back limiting belt, which are arranged in parallel, are provided in the filling region in a width orientation of the mattress; an upper end and a lower end of each of the limiting belts for parts of the human body are connected to the elastic surface layer connecting cloth and the lower connecting cloth, respectively; the limiting belts are configured to buffer the granular fillers and limit a flowing region of the granular fillers, such that the granular fillers move within areas limited by the limiting belts; the limiting belts are unevenly distributed, and the width of each of the limiting belts is less than that of the filling region, such that a passage substantially perpendicular to the limiting belts for flow of the granular fillers is formed on each side of the limiting belts; the passage communicates with the areas limited by the limiting belts; the lower connecting cloth is composite reticulate sandwich cloth with air permeability and thermal conductivity, and the composite reticulate sandwich cloth consists of a top surface, a middle layer and a bottom surface, wherein the top surface is of a mesh design, the middle layer is yarn for connecting the top surface and the bottom surface, and the bottom surface is a densely-woven flat face.

2. The mattress of claim 1, wherein the granular fillers are movable granules of a spherical or oval structure.

3. The mattress of claim 1, wherein there are two hip limiting belts.

4. The mattress of claim 1, wherein an elastic support frame is located at the front or rear sides of the elastic support frames.

5. The mattress of claim 1, wherein the granular fillers are made of polyurethane foam, and a lateral upright isolating cloth, used for isolating the granular fillers, is provided on a side of each of the elastic support frames.

6. The mattress of claim 4, wherein the granular fillers are made of polyurethane foam, and a lateral upright isolating cloth, used for isolating the granular fillers, is provided on a side of each of the elastic support frames.

* * * * *